United States Patent [19]

Anderson

[11] 4,014,388

[45] Mar. 29, 1977

[54] CONCEALED SPRINKLER ASSEMBLY

[75] Inventor: James R. Anderson, Berwyn, Pa.

[73] Assignee: Central Sprinkler Corporation, Lansdale, Pa.

[22] Filed: June 21, 1976

[21] Appl. No.: 698,479

[52] U.S. Cl. ..... 169/37; 169/42

[51] Int. Cl.[2] ..... A62C 37/12; A62C 37/30

[58] Field of Search ..... 169/37, 42, 51, 57, 169/19

[56] References Cited

UNITED STATES PATENTS

| | | | |
|---|---|---|---|
| 2,389,331 | 11/1945 | Tyden | 169/37 |
| 3,198,258 | 8/1965 | Werner | 169/37 |
| 3,393,746 | 7/1968 | Hodnett | 169/42 X |
| 3,714,989 | 2/1973 | Gloeckler | 169/19 |
| 3,727,695 | 4/1973 | Danton | 169/37 |

*Primary Examiner*—Robert S. Ward, Jr.
*Attorney, Agent, or Firm*—Fishburn, Gold & Litman

[57] ABSTRACT

A concealed, flush mounted sprinkler is disclosed which comprises a slidable deflector which, in the event of fire, is extended to an operating position by means of a compressed spring. The nozzle, a thermally responsive element, and the deflector of the sprinkler reside within a receptacle having an outer cover against which the deflector is continuously pressured by means of the spring. The cover is attached to the receptacle by means of a fusible eutectic alloy, and as the alloy begins to soften and become elastic during a fire, the compressed spring aids detachment of the cover from the receptacle while simultaneously sliding the deflector to an operating position beyond the ceiling or sidewall in which the sprinkler is mounted.

12 Claims, 9 Drawing Figures

Fig. 1.
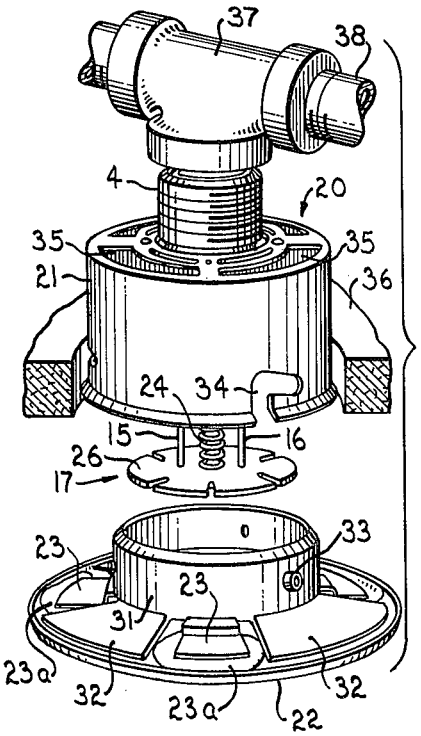
Fig. 2.
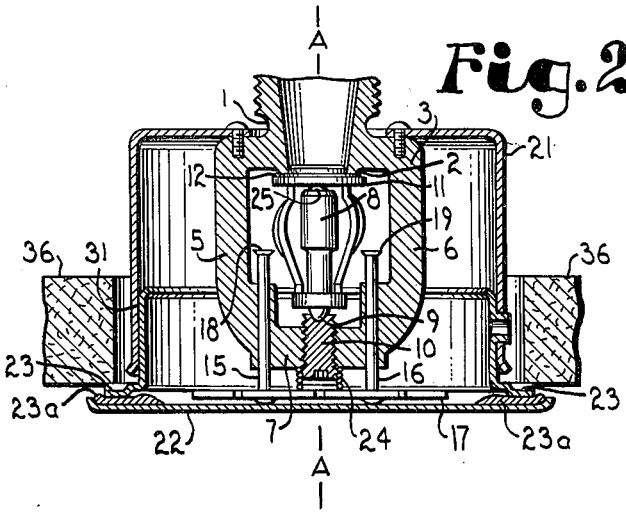
Fig. 3.
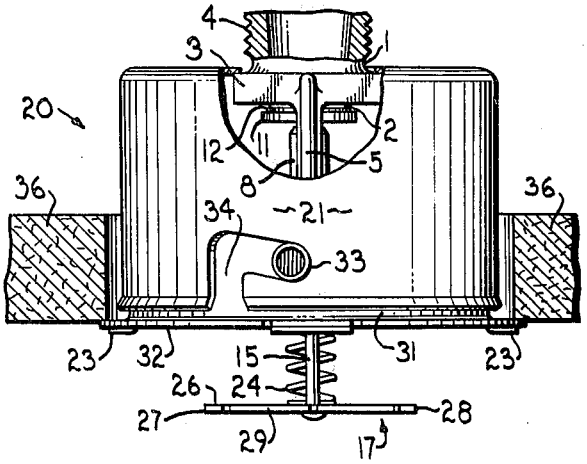
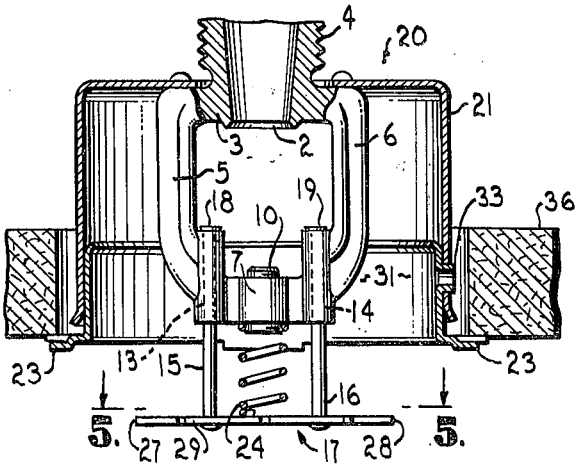
Fig. 4.
Fig. 5.
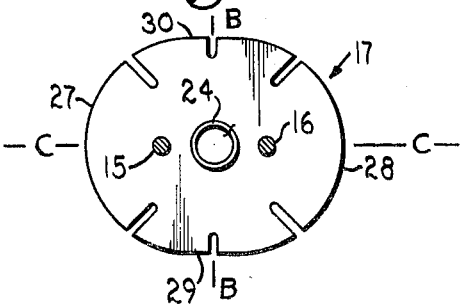

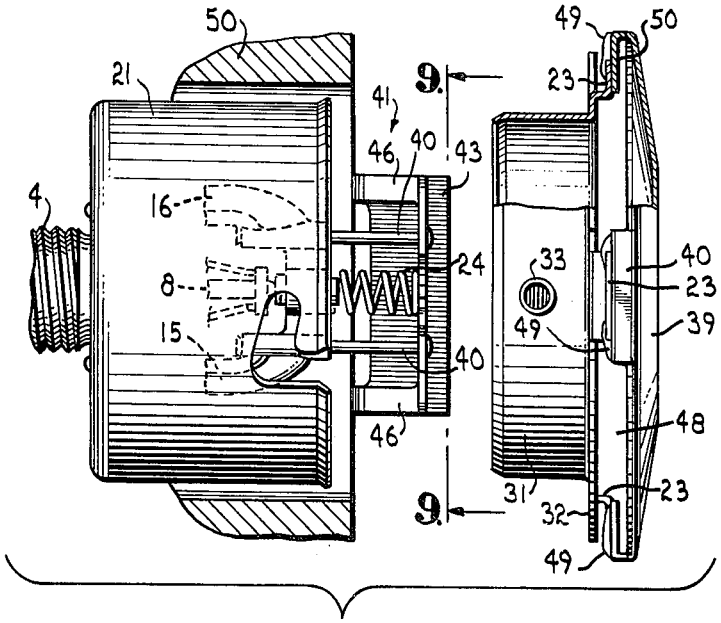
Fig. 6.
Fig. 7.
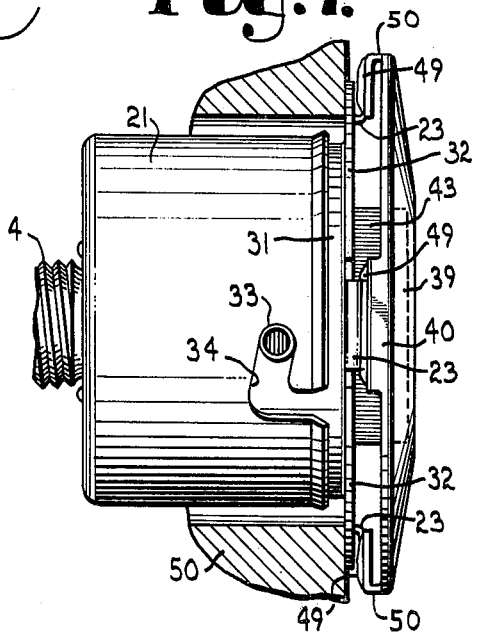
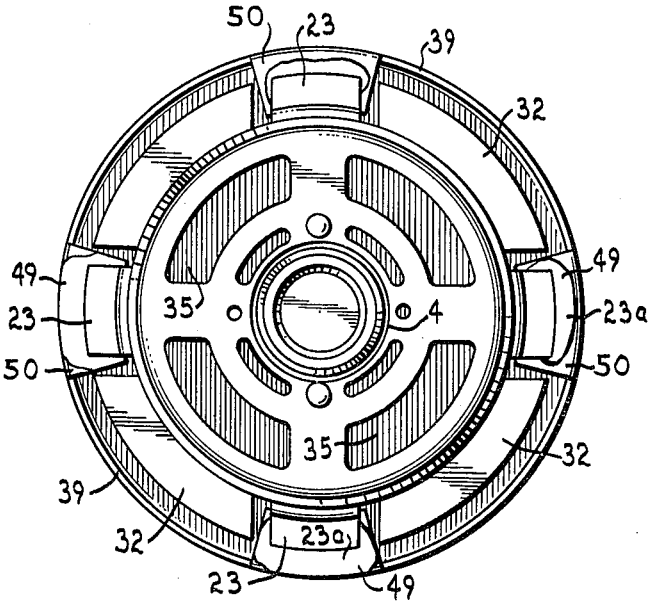
Fig. 8.
Fig. 9.
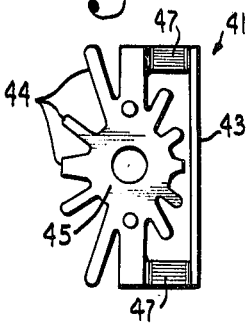

CONCEALED SPRINKLER ASSEMBLY

BACKGROUND OF THE INVENTION

The present invention pertains to sprinklers such as are employed for fire extinguishing purposes, and more particularly pertains to sprinklers that are flush mounted in the ceiling or a sidewall of a structure being protected against fire.

Despite their indisputed effectiveness in fighting fires, automatic or manually operated sprinkler systems are sometimes regarded to be esthetically distasteful when the sprinkler heads are visible after the system is installed. In an effort to overcome this problem, various types of flush mounted sprinklers have been proposed, e.g. as disclosed in U.S. Pat. Nos. 2,389,331; 2,558,450; 3,198,258; 3,459,266 and 3,714,989. Problems with prior flush mounted sprinklers have been largely associated with the fact that the deflector for producing a spray or droplets must be retained in a retracted position inside a recessed receptacle prior to a fire, and must somehow be moved to a position outside the receptacle when a fire occurs, otherwise the ceiling or wall in which the sprinkler is mounted can seriously interfere with the intended liquid distribution pattern of the sprinkler when it is spraying water. Previous apparatus combinations for effecting concealment of the sprinkler while also provided for extension of the deflector to an operating position during a fire have frequently been too complex and costly, or of doubtful reliability.

SUMMARY OF THE INVENTION

It is therefore an object of the present invention to provide an improved flush mounted sprinkler whereby the aforementioned problems and difficulties associated with prior sprinklers is avoided.

Another object is to provide an improved sprinkler that can be flush mounted in either the ceiling or a sidewall of a structure being protected against fire.

Still another object is to provide an improved flush mounted sprinkler that is simple in construction, yet reliable in the event of fire.

Even another object is to provide an improved flush mounted sprinkler having a simple and reliable means for forcefully extending a normally retracted deflector into an operating position in the event of fire.

Yet another object is to provide an improved flush mounted sprinkler having a normally retracted deflector that is automatically extended into an operating position prior to discharge of liquid from the nozzle of the sprinkler.

Another object is to provide an improved flush mounted sprinkler having an outer cover or escutcheon plate mounted on a bracket of the sprinkler by means of a fusible eutectic alloy.

Other objects and advantages of the invention will become apparent from the following description and the drawings.

In accordance with the present invention, a sprinkler of the flush mounted type comprises a sprinkler body with a nozzle therein, a bracket attached to the sprinkler body, an outer cover plate attached to the bracket by means of a bonding material having a relatively low softening point, and a deflector which rests against the cover in a normally retracted position while also being positioned to intercept and divert a stream of liquid discharged from the nozzle, the deflector being slidable away from the nozzle upon detachment of the cover from the receptacle. Urging means is provided whereby the deflector is continuously pressed against the cover plate for aiding in the detachment thereof upon softening or melting of the bonding material, and whereby the deflector is slid into an operating position upon detachment of the cover plate.

BRIEF DESCRIPTION OF THE DRAWINGS

FIG. 1 is a partially exploded perspective view of a flush, ceiling mounted sprinkler constructed in accordance with the present invention.

FIG. 2 is a side sectional view of the sprinkler shown in FIG. 1.

FIG. 3 is a side view, shown partly in section, of the sprinkler shown in FIGS. 1 and 2.

FIG. 4 is a side sectional view of the sprinkler of FIGS. 1–3 and show the sprinkler in an operating condition following outward extension of the deflector and discharge of the thermally responsive element therefrom following activation of the element.

FIG. 5 is a top view of the deflector used with the sprinkler shown in FIGS. 1–4.

FIG. 6 is a partially exploded side view of a sidewall, flush mounted sprinkler constructed in accordance with the present invention.

FIG. 7 is a side view of the sprinkler of FIG. 6, and shows the sprinkler in a fully assembled state.

FIG. 8 is a view of the inner end of the sprinkler shown in FIGS. 6 and 7.

FIG. 9 is a view of the outer end of the deflector used with the sprinkler shown in FIGS. 6–8.

DESCRIPTION OF PREFERRED AND ALTERNATIVE EMBODIMENTS

As shown in FIGS. 1–5, the sprinkler comprises a body 1 having a nozzle 2, a yoke frame 3, and a threaded connector 4 thereon. The yoke frame comprises two arms 5 and 6 which extend away from the nozzle longitudinally with respect to the discharge axis A—A of the nozzle, and the arms merge at junction 7 in front of the nozzle. Located between nozzle 2 and junction 7 is a thermally responsive element 8 of the frangible pellet type. The outer tip 9 of the element rests in a socket in the inner end of the set screw 10. The inner end of the element is a cap 11 and a polymeric or soft metallic disc 12 is placed between the cap and the nozzle to provide a seal against leakage of a fire extinguishing fluid, such as water, that is supplied through connector 4 from the pipe tee 37 and supply pipe 38. The pressure applied to the disc 12 by means of cap 11 of the element is regulated by turning the set screw 10.

The arms 5 and 6 have channels 13 and 14 therein, represented by the dotted lines in FIG. 4, which are parallel to the discharge axis A—A of the nozzle. Rods 15 and 16 extend through these channels and are slidable inwardly and outwardly therein. One end of the rods is attached to the deflector plate 17, whereas the other end has a slide stopping means 18 and 19, e.g. retaining heads, to prevent passage of the rods through the channels, and thereby serving as means for retaining the deflector plate on the sprinkler.

The entire sprinkler, other than connector 4, is contained within an enclosure 20 which comprises a cylindrical receptacle 21, connector ring 31 and cover or escutcheon plate 22. This cover plate is attached to tabs 23 on the connector ring 31 by means of solder 23a having a relatively low melting point, e.g. 135° F. With cover 22 fastened in place as shown in FIG. 2, the deflector plate 17 is held inward in a retracted position toward the junction 7 of the yoke arms, and the compressed spring 24 between the junction and the deflector continuously urges the deflector 17 and cover 22 outwards. Should a fire occur within an enclosed space wherein the sprinkler is located, the heat from the fire will first soften or melt the solder that is holding cover 22 on the connector ring 31, the solder joint will thus loosen so that the lid can detach from the ring and drop off, with detachment from the ring being aided by pressure exerted from the compressed spring 24. Subsequently, the frangible pellet in thermally responsive element 8 will melt, whereupon ball 25 will retract into the element so that pressure on the disc 12 and the cap 11 will be released, allowing water supplied by line 38 to be discharged through the nozzle 2. Following thermal activation of the element 8, it is knocked aside and thrust out of the enclosure 20 by the water so that a substantially solid stream thereof can be directed onto the upper surface 26 of the deflector.

It should be pointed out that the deflector 17 becomes extended to an operating position, as represented in FIG. 3, prior to activation of the thermal element, and hence prior to forceful jetting of a water stream from the nozzle against the upper face 26 of the deflector. This provides the advantage of preventing forceful impaction of the rod stops 18 and 19 against the yoke arms 5 and 6 as would occur if only the momentum of the water stream were relied upon for moving the deflector plate to a fully outward, operating position. FIG. 4 represents the sprinkler following the activation thereof in response to heat, and thus shows the absence of the thermally responsive element 8, and the extension of the deflector 17 outside of the receptacle 21 and below the ceiling 36 in which the sprinkler is mounted.

Use of an urging means, such as compressed spring 24, in conjunction with the deflector provides several advantages not available from prior sprinklers. By maintaining pressure against the cover 22 by means of the spring, the detachment thereof can occur earlier than in the absence of such a spring, i.e. as soon as the solder holding the cover is sufficiently softened to become elastic, the cover can be forced off by the spring even before the solder melts completely, and in which case an earlier activation of the thermally responsive element can occur. Also, since it is preferred that the deflector be fully extended to an operating position before the water starts to flow, the spring 24 provides positive assurance that full extension occurs, since the force of gravity alone cannot always be relied upon to overcome the hinderence to extension that can be caused by accumulation of dust, dirt, etc. on the rods 15 and 16.

Other features of the sprinkler enclosure and the flush mounting thereof are shown in the drawings, especially FIG. 1. When installing the sprinkler, the tee 37 in water line 38 is aligned over a hole cut in the ceiling 36 therefor. A first assembly comprising the nozzle, the thermal element, the deflector and spring, and the attached receptacle are then inserted into the hole, and the connector 4 is screwed into the tee 37. (Where preferred, the sprinkler can be connected to the tee before insertion into the hole.) A second assembly comprising the cover 22 and a connector ring 31 is then inserted into the receptacle and fastened thereto by means of extended pinlike projections or locking pins 33 which insert into channels 34 to establish a locking relationship, in the form of a bayonet joint, between the ring and the receptacle, when the ring is turned therein. As can be seen from FIG. 2, insertion of the ring 31 into the receptacle effects compression of spring 24 and movement of the deflector 17 to a fully retracted position whereby the outer cover 22 is very nearly flush with the outer surface of the ceiling 26. It should also be noted that the receptacle 21 has vents 35 in the end thereof opposite the cover. The purpose of these vents is to permit circulation through the enclosure so that heated air and/or hot combustion gases will pass through the enclosure and activate the thermal element of the sprinkler as soon as possible.

As was previously indicated, the cover 22 at the outer end of the connector ring is attached thereto by means of tabs 23, and it can be seen from the drawings that these tabs are integral, radially projecting parts of the connector ring portion of the enclosure. Optionally, the connector ring can further comprise radially projecting fins 32 to facilitate reinforcement and alignment of the cover, but which are not soldered thereto. Although fusible eutectic alloys such as solders are preferred bonding materials for fastening the outer cover 22 to the connector ring of the sprinkler, other materials such as fusible thermoplastic adhesives which soften and become elastic at relatively low temperatures can be used when preferable and practical. It is also preferable that the bonding material for attaching the cover become softened or fully melted at a temperature lower than that at which the thermally responsive element of the sprinkler is activated (if any such an element is used), since rapid detachment of the cover from the connector ring and early activation of the element is thereby facilitated.

Although particular reference has been given to use of an enclosure having a receptacle which serves as a bracket for attachment of the cover plate 22 to the sprinkler, it will be understood that full enclosure of the sprinkler is not essential, and that other forms of brackets can be used, e.g. one or more angular straps, rods, or the like, the main consideration being provision for attachment and detachment of the cover plate, as previously described. It will also be understood that means other than a compressed spring can be used as an urging means, e.g. a compressed elastomeric compound or a compressed, gas filled bellows, but use of a spring is generally preferred since it provides the needed reliability at a low cost. Various other means can also be employed for providing a slidable deflector. The rods 15 and 16 can be placed outwardly of the yoke arms 5 and 6 so that they extend through guides in the receptacle 21, and only one or more than two of such rods can be used where preferable and practical.

Although the present sprinkler can be provided with a deflector having any desired configuration, there is an advantage in using a deflector 17 as shown in FIGS. 1–5 when the sprinkler is mounted in a ceiling. This particular deflector is provided with a special shape so as to provide a round pattern of droplets by compensating for variation in divergence of the liquid stream from the nozzle as a result of its striking the yoke arms 5, 6 and junction 7. An inner face on the deflector plate 17, which lies opposite the nozzle and transversely of the discharge axis A—A, is represented at 26. This inner face is oblong and has a minor width axis B—B and a major width axis C—C. Curved outer edges 27 and 28 of the face 26 are located laterally of the minor width axis and merge with substantially straight edges 29 and 30 located laterally of the major width axis. Preferably, the inner face 26 is flat and is positioned not only transversely of the nozzle discharge axis A—A, but also perpendicularly with respect thereto. To advantage, the deflector is located outwardly of the junction of the yoke so that the urging means can extend between the deflector and the junction. When the deflector has a configuration as shown in FIG. 5 for delivery of a round pattern of droplets, the major width axis C—C of the deflector should be aligned, as shown, substantially coincident with the plane occupied by the arms of the yoke.

FIGS. 6–9 illustrate a sprinkler built in accordance with this invention that can be flush mounted in a sidewall 50 of a structure being protected against fire. The deflector of this sprinkler has a different configuration from that shown in FIGS. 1–5 so that a pattern of droplets can be discharged laterally into a confined space being protected. Deflector 41 is thus provided with a shield 43 to prevent unwanted divergence of liquid droplets into an area guarded by the shield (so that all of the droplets can be broadcast into a desired area). The deflector further comprises a plurality of radial arms 44, which extend from centerpiece 45, that facilitate atomization and scattering of the droplets. The shield 43 and the centerpiece 45 are interconnected by means of struts 46 and spacers 47. The deflector is attached to the yoke arms 5 and 6 of the sprinkler by means of rods 40 similar to the rods 16 described above, and compressed spring 24 is used for extension of the deflector from the receptacle 21 of the sprinkler. Retraction and extension of the deflector, and detachment of the cover 39 from the receptacle, is thus accomplished in the same fashion as with the sprinkler described with reference to FIGS. 1–5.

It should be pointed out, however, that the cover plate 39 used with this wall mounted sprinkler of FIGS. 6–9 is somewhat different from that shown in FIGS. 1–5 in being outwardly concaved and having cover plate tabs 50 for attachment of the cover to the connector ring tabs 23. These tabs 50 extend rearwardly of the cover plate 39 so that a space 48 remains between the cover plate and the receptacle when the two are soldered together, thereby permitting circulation of heated air and/or hot combustion gases over the tabs and through the receptacle for softening or melting of the solder joints 49. This same type of cover can also be used with the ceiling mounted sprinkler shown in FIGS. 1–5, and it will be appreciated that full outward extension of the deflector prior to jetting of water is accomplished by means of the spring 24, and that early detachment of the cover 39 during a fire is also aided by the spring.

A flush mounted sprinkler which fulfills the previously stated objects has now been disclosed in detail, and although the invention has been described with reference to particular apparatus, combinations and arrangements of apparatus, conditions of use, and the like, it will nonetheless be understood that even other embodiments will become apparent which are within the spirit and scope of the invention defined in the following claims.

What is claimed and desired to secure by Letters Patent is:

1. A sprinkler of the flush mounted type which comprises:

a. a sprinkler body having a nozzle therein, b. a bracket attached to the sprinkler body, c. an outer cover plate attached to the bracket by means of a bonding material having a relatively low softenpoint, d. a deflector which rests against the cover in a normally retracted position and which is also positioned to intercept and divert a stream of liquid discharged from the nozzle, the deflector being slidable away from the nozzle with respect to the discharge axis thereof, and e. urging means whereby said deflector is continuously pressed against the cover for aiding the detachment thereof from the bracket upon softening of the bonding material, and whereby the deflector is slid into an operating position upon detachment of the cover.

2. A sprinkler as in claim 1 wherein said bracket is an enclosure comprising a receptacle having an outer end to which said cover plate is attached, said sprinkler body, said deflector, and said urging means being housed within the receptacle, said deflector being slidable to an operating position outside of the receptacle upon detachment of the cover plate therefrom.

3. A sprinkler as in claim 1 wherein said urging means is a compressed spring.

4. A sprinkler as in claim 1 wherein said bonding material is a fusible eutectic alloy.

5. A sprinkler as in claim 1 and further comprising a yoke frame having two arms which merge at a junction in front of said nozzle, and wherein said deflector is located outwardly of said junction.

6. A sprinkler as in claim 5 wherein said urging means extends between said junction of the yoke and said deflector.

7. A sprinkler as in claim 5 in which said deflector has an inner face opposite said nozzle with a major and a minor width axis, and wherein said major axis is substantially coincident with the plane occupied by said arms of the yoke frame.

8. A sprinkler as in claim 5 and further comprising a channel through said yoke frame that is substantially parallel to the discharge axis of said nozzle, a rod which extends through said channel and is slidable therein, and wherein one end of said rod is affixed to said deflector, whereas the other end of the rod has a slide stopping means thereon.

9. A sprinkler as in claim 8 and further comprising two of said channels and two of said rods, said channels extending through said arms of the yoke frame, and wherein said ends of the rods having the slide stopping means reside inwardly of said arms.

10. A sprinkler as in claim 2 wherein said receptacle comprises vents therein.

11. A sprinkler as in claim 1 and further comprising a thermally responsive element which resides between said nozzle and said junction of the yoke, said bonding material for attachment of said cover being meltable at a temperature lower than that at which said element is thermally responsive.

12. A sprinkler as in claim 10 wherein said element is of the frangible pellet type.

* * * * *